US011176769B2

(12) United States Patent
Polad

(10) Patent No.: US 11,176,769 B2
(45) Date of Patent: Nov. 16, 2021

(54) CURRENCY ARRANGING AND STACKING APPARATUS

(71) Applicant: Alan Polad, Costa Mesa, CA (US)

(72) Inventor: Alan Polad, Costa Mesa, CA (US)

( * ) Notice: Subject to any disclaimer, the term of this patent is extended or adjusted under 35 U.S.C. 154(b) by 302 days.

(21) Appl. No.: 16/438,487

(22) Filed: Jun. 12, 2019

(65) Prior Publication Data

US 2020/0394865 A1 Dec. 17, 2020

(51) Int. Cl.

| | |
|---|---|
| ***G07D 11/16*** | (2019.01) |
| ***G07D 11/50*** | (2019.01) |
| ***G07D 11/12*** | (2019.01) |
| ***G07D 11/22*** | (2019.01) |
| ***G07D 11/165*** | (2019.01) |
| ***G07D 11/17*** | (2019.01) |

(52) U.S. Cl.

CPC ..... *G07D 11/50* (2019.01); *G07D 11/12* (2019.01); *G07D 11/165* (2019.01); *G07D 11/17* (2019.01); *G07D 11/22* (2019.01)

(58) Field of Classification Search

CPC ..... B65H 47/00; G07D 7/183; G07D 11/00; G07D 11/009; G07D 11/12; G07D 11/13; G07D 11/16; G07D 11/165; G07D 11/17; G07D 11/175; G07D 11/18

See application file for complete search history.

(56) References Cited

U.S. PATENT DOCUMENTS

2013/0180218 A1* 7/2013 Sakoguchi ..... B65B 13/12 53/540
2018/0005480 A1* 1/2018 Lundblad ..... G07F 19/203

* cited by examiner

*Primary Examiner* — Thien M Le
*Assistant Examiner* — April A Taylor
(74) *Attorney, Agent, or Firm* — Edwin Tarver

(57) ABSTRACT

A currency arranging and stacking apparatus with a hopper for receiving a plurality of paper currency bills and a bill stacker for receiving and stacking unfolded and paper currency bills in a common orientation. Between the hopper and bill stacker, the apparatus includes a currency unfolding apparatus, the currency unfolding apparatus having a vacuum belt under negative pressure for holding the paper currency bills and a wheel engaging the vacuum belt that rotates at a speed different from the vacuum belt, thereby unfolding folded paper currency bills. A currency creasing apparatus comprising a first creasing wheel and a second creasing wheel, creases the paper currency bills to prevent them from re-folding before uniform assembly in the bill stacker.

20 Claims, 4 Drawing Sheets

CURRENCY ARRANGING AND STACKING APPARATUS

BACKGROUND

Field of the Invention

The present invention generally relates to paper currency arrangement manipulation. More specifically, the present invention relates to an apparatus for receiving paper currency bills, disorganized and in bulk, and automatically arranging and stacking the paper currency for transport and counting.

Related Art

Paper currency manipulating apparatus are known in the art. Currently, such apparatus comprise paper currency counters for determining the value of a number of bills inserted into the machine. Scanners within modern counters may detect bills of differing value, such that a stack of differently valued bills may be placed in the counter, and quickly and accurately counted.

One drawback with current automated systems is that the individual paper bills must be arranged in an organized stack prior to counting. Although scanning currency counters may be able to read bills according to value, and whether forward or backward, the bills must be arranged in peripheral contour in order to be placed in a counting machine. In certain circumstances, paper currency bills are received in a holding apparatus in which they are deposited in bulk. For example, many paper currency readers include a cash box into which paper currency falls, resulting in a disordered quantity of bulk bills. Depending on the quantity of bills, the process of sorting the bills into uniform stacks that may be automatically counted is a time and labor intensive process.

Therefore there is a need for an apparatus for automatically sorting and arranging paper currency bills such that they can be retrieved and inserted into an automatic counting apparatus. There is also a need for an apparatus that arranges the paper currency bills in the same orientation. There is also a need for an apparatus that unfolds any folded paper currency bills, since bills are stored folded and prone to re-folding. Finally there is a need for an apparatus that slightly creases the paper currency bills to ensure that they stay unfolded after processing, as they are stacked in organized piles. These, and other objects of the present invention are more specifically detailed in the following summary, description, claims, and illustrations.

SUMMARY

A currency arranging and stacking apparatus includes a motorized hopper for receiving a plurality of paper currency bills, and a bill stacker for receiving and stacking unfolded and paper currency bills in a common, uniform orientation. In a primary embodiment, the apparatus includes a feed hopper designed to receive a plurality of paper currency bills deposited therein in bulk. A pocket conveyor is arranged to elevate the paper currency bills and deposit them into the motorized hopper.

The motorized hopper includes at least one feed regulator configured for separating overlapping individual paper currency bills such that they are preferably individually dispensed from the motorized hopper. A slider, preferably arranged under the motorized hopper, is arranged for receiving the separated individual paper currency bills. The slider includes a series of slider slots, and the slider slots are arranged to ensure individual paper currency bills are oriented lengthwise and parallel to the slider slots.

A transport is included for receiving the paper currency bills oriented by the slider. The transport includes a currency unfolding apparatus, which has a vacuum belt under negative pressure for holding the paper currency bills against the vacuum belt. The vacuum belt moves the currency along the transport, and under a lower wheel which engages the vacuum belt. The lower wheel rotates at a speed different from the vacuum belt, thereby unfolding folded paper currency bills traveling between the lower wheel and the vacuum belt.

A currency creasing apparatus is provided, including a first creasing wheel and a second creasing wheel, between which the unfolded individual paper currency bills travel. The first creasing wheel and the second creasing wheel crease the paper currency bills lengthwise to prevent the paper currency bills from re-folding before transmission to the bill stacker. From the bill stacker, arranged and stacked bills may be retrieved for further transport.

Preferably, the pocket conveyor comprises a series of pockets for capturing a predetermined quantity of paper currency bills from the feed hopper. The motorized hopper may include at least one motorized feed regulator for separating overlapping paper currency bills prior to depositing them on the slider. The slider may include a plurality of channels for receiving the paper currency bills from the motorized hopper. The currency unfolding apparatus preferably includes a servo motor configured to drive an upper wheel, with the upper wheel configured to drive the lower wheel.

The first creasing wheel of the currency creasing apparatus includes at least one channel, and preferably two channels. The first creasing wheel also preferably includes a channel on either circumferential edge of the first creasing wheel. The second creasing wheel includes at least one, and preferably two, complimentary channels configured to fit into the channel of the first creasing wheel. To properly crease individual paper currency bills, the first creasing wheel is made from a rubber or rubber-like material, while the second creasing wheel is made from a metal material, such as steel.

In an alternative embodiment, the apparatus may be characterized as a currency arranging and stacking apparatus having a motorized hopper for receiving a plurality of paper currency bills, and a bill stacker for receiving and stacking unfolded and paper currency bills in a common orientation. The apparatus includes a feed hopper configured for receiving a plurality of paper currency bills in bulk. A pocket conveyor is configured to elevate the paper currency bills and deposit them into the motorized hopper, and the motorized hopper comprises at least one feed regulator configured for separating overlapping individual paper currency bills.

A slider is provided for receiving the separate individual paper currency bills, and the slider includes a series of slider slots oriented to cause individual paper currency bills to arrange themselves lengthwise and parallel to the slider slots. A currency unfolding apparatus includes a moving vacuum belt and a lower wheel that engages the vacuum belt. The lower wheel is configured to turn in the same direction as the vacuum belt, but at a different speed to unfold the currency. The vacuum belt being under negative pressure for holding the paper currency bills against the vacuum belt, allowing the lower wheel to act on the bills. A currency creasing apparatus is also provided, including a first creasing wheel and a second creasing wheel. The first creasing wheel and the second creasing wheel crease the paper currency bills lengthwise to prevent them from re-folding before transmission to the bill stacker.

In this embodiment, the currency unfolding apparatus also includes a servo motor configured to drive an upper wheel, with the upper wheel configured to drive the lower wheel. Additionally, the first creasing wheel includes at least one, and preferably two channels. The first creasing wheel may include a channel on either circumferential edge of the first creasing wheel, and the second creasing wheel includes at least one complimentary channel configured to fit into the channel of the first creasing wheel. Preferably, the first creasing wheel is made of rubber, or a rubber-like material, and the second creasing wheel comprises a metal material, such as steel.

In another alternative embodiment, the apparatus may be characterized as a currency arranging and stacking apparatus having a motorized hopper for receiving a plurality of paper currency bills, and a bill stacker for receiving and stacking unfolded and paper currency bills in a common orientation. The apparatus includes a currency unfolding apparatus downstream from the motorized hopper, with the currency unfolding apparatus including a moving vacuum belt and a lower wheel engaging the vacuum belt, the lower wheel configured to turn in a complimentary direction to the vacuum belt, and further configured to turn at a speed different from the vacuum belt, the vacuum belt being under negative pressure for holding the paper currency bills against the vacuum belt.

A currency creasing apparatus is downstream from the currency unfolding apparatus, the currency creasing apparatus having a first creasing wheel and a second creasing wheel, with the first creasing wheel and the second creasing wheel adapted to crease the paper currency bills lengthwise to prevent the paper currency bills from re-folding before transmission to the bill stacker.

In this embodiment the currency unfolding apparatus also includes a servo motor adapted to drive an upper wheel, with the upper wheel configured to drive the lower wheel. The first creasing wheel includes a channel on either circumferential edge of the first creasing wheel, and the second creasing wheel includes at least one complimentary channel configured to fit into the channel of the first creasing wheel. The first creasing wheel preferably is made of rubber, or a rubber-like material, while the second creasing wheel is preferably made of steel.

REFERENCE NUMBERS

Figure 1:
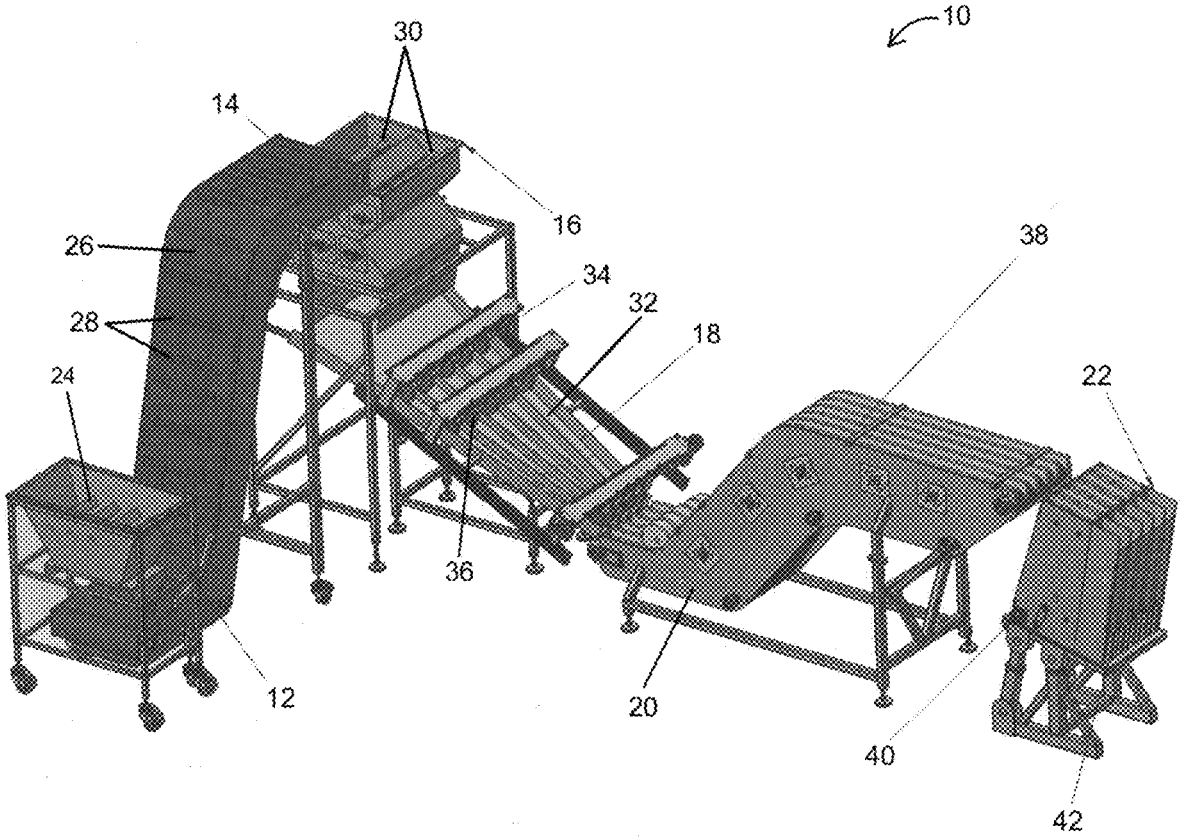
FIG. 1 illustrates a perspective view of a currency arranging and stacking apparatus.

10. currency stacking apparatus
12. feed hopper
14. pocket conveyor
16. motorized hopper
18. slider
20. belt transport
22. bill stacker
24. feed hopper ribs
26. pocket conveyor belt
28. pocket
30. feed regulators
32. slider slots
34. orientation servo motors
36. orientation wheels
38. vacuum belt
40. servo motors
42. bill output
44. currency unfolding apparatus
46. servo motor
48. upper wheel
50. lower wheel
52. openings
54. vacuum apparatus
56. currency creasing apparatus
58. first creasing wheel
60. channel
62. second creasing wheel
64. bead

DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Referring to FIG. 1, the currency arranging and stacking apparatus 10 includes several main components, including a feed hopper 12, a pocket conveyor 14, a motorized hopper 16, a slider 18, a belt transport 20, and a bill stacker 22. In operation, paper (or similar) currency (not shown) is placed in the feed hopper 12. The paper currency may be simply dumped into the feed hopper 12 in bulk, and the feed hopper 12 preferably includes a series of feed hopper ribs 24 for initially separating the currency into individual bills. The currency exits the bottom of the feed hopper 12, spilling onto the pocket conveyor 14. The pocket conveyor 14 includes a motorized pocket conveyor belt 26 with a series of pockets 28 that carry the currency up to emptied into the motorized hopper 16.

The motorized hopper 16 includes a series of motorized feed regulators 30 that separate overlapping individual bills before depositing them at the top of the slider 18. The slider 18 includes a series slider slots 32 along which the individual currency travels. Over each of the slider slots, a series of orientation servo motors 34 are positioned. The servo motors govern the operation of orientation wheels 36 in each of the slider slots 32 that unfold folded currency as it travels through each slider slot. A vacuum belt 38 in the belt transport 20 transports the bills from the slider 18 to the bill stacker 22. Servo motors 40 in the bill stacker assist with the collection of the currency, which is assembled in a bill output 42 from which stacked organized currency may be retrieved.

Figure 2:
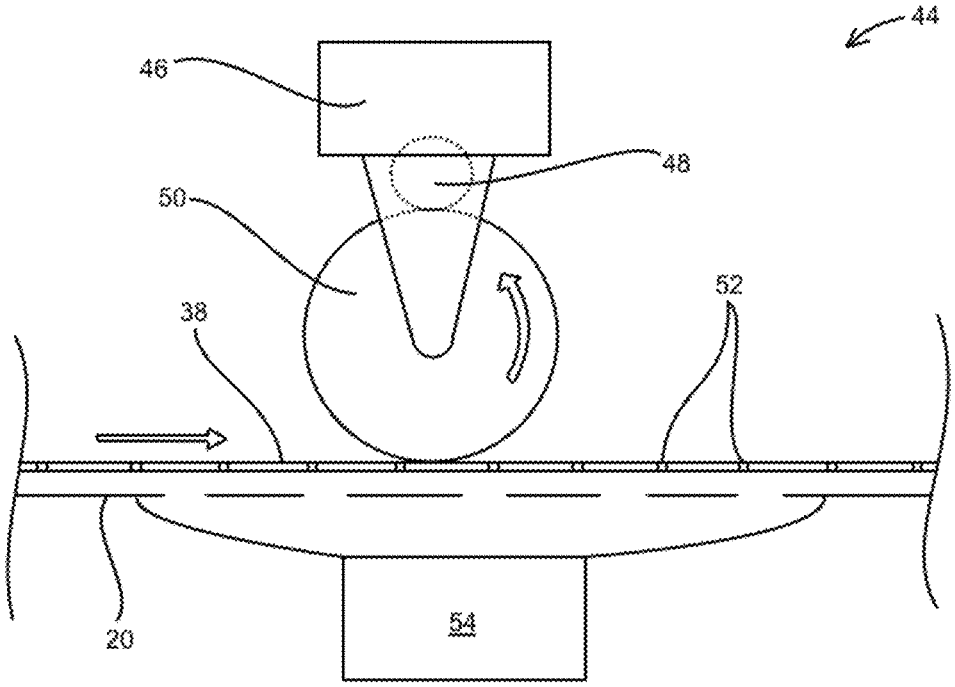
FIG. 2 illustrates an elevation view of a currency unfolding apparatus of the currency arranging and stacking apparatus.
Figure 3:
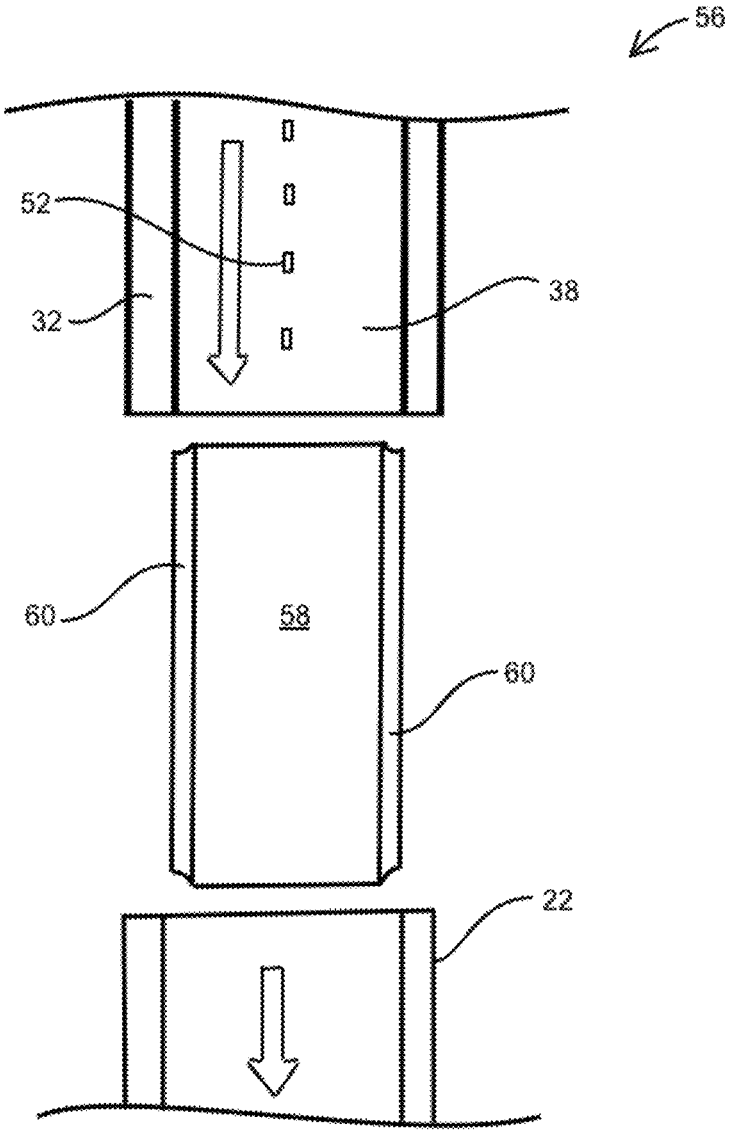
FIG. 3 illustrates a top view of a currency creasing apparatus of the currency arranging and stacking apparatus.
Figure 4:
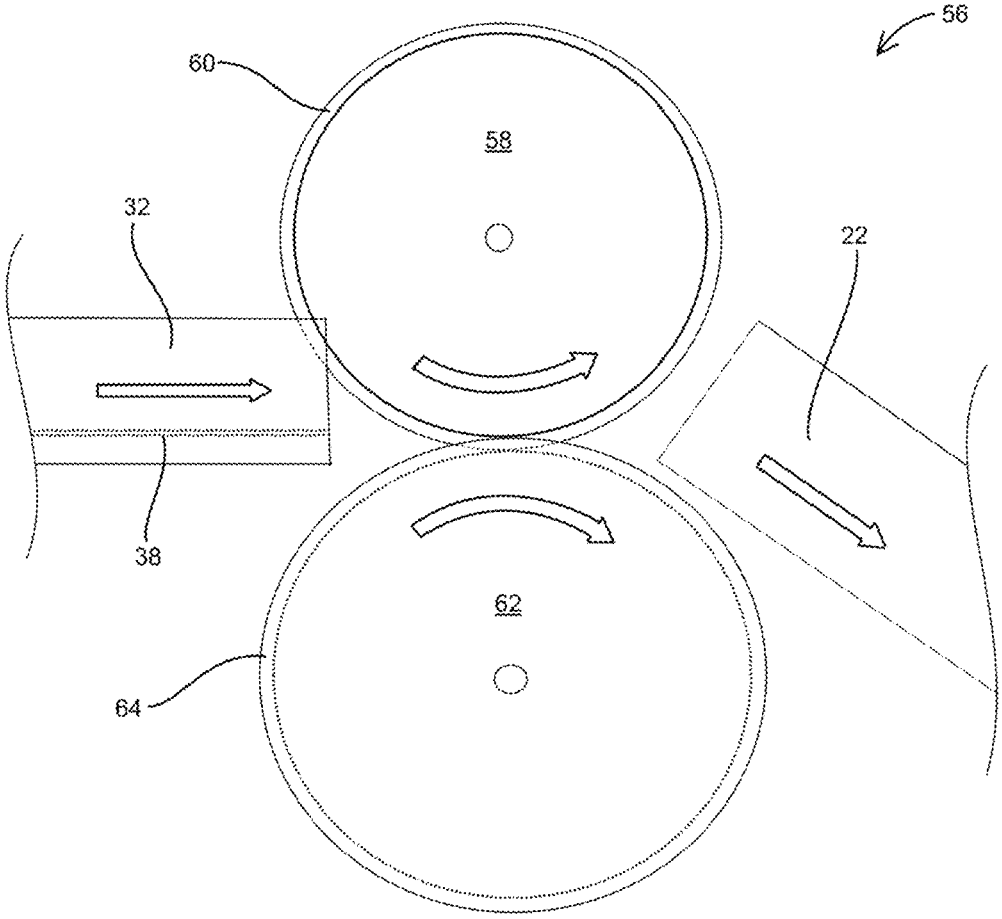
FIG. 4 illustrates an elevation view of a currency creasing apparatus of the currency arranging and stacking apparatus.

Referring to FIGS. 2-4, there are two specific elements along currency transit of the stacking apparatus 10 designed to first unfold the currency, and then to prevent the currency from re-folding. FIG. 2 illustrates a currency unfolding apparatus 44 designed to unfold individual units of paper currency into a flat single layer. Frequently, paper currency bills are folded in half, and stored folded in half, which causes them to remain folded when handled in bulk. The currency unfolding apparatus 44 addresses this problem.

Still referring to FIG. 2, each currency unfolding apparatus 44 includes a servo motor 46 and an upper wheel 48, serving as a drive wheel, and configured to drive a lower wheel 50 that acts on individual folded bills. The vacuum belt 38 travels under the lower wheel 50. The vacuum belt 38 preferably includes a series of openings 52 for air passage. A vacuum apparatus 54 is provided, preferably under the belt transport 20 apparatus, for creating negative airflow through the openings 52.

The lower wheel 50 travels in the same direction as the vacuum belt 38 as shown by the arrows in FIG. 2. However, the lower wheel 50 does not travel in tandem with the vacuum belt 38. When a folded currency passes under the lower wheel 50, the lower half of the folded currency is held fast against the vacuum belt 38, whereas the upper half of the folded currency may be moved relative to the lower half. When the upper half of the folded currency encounters the lower wheel 50, the servo motor 46 detects the ability to move the upper half and changes the velocity of the upper wheel 48, and thus the lower wheel 50 in a manner that unfolds the currency. The unfolded bill then proceeds away from the currency unfolding apparatus 44, held against the vacuum belt by the vacuum apparatus 54.

Referring to FIGS. 3 and 4, the currency creasing apparatus 56 is shown. Because folded bills have a tendency to re-fold, as described above, the currency creasing apparatus 56 is provided to keep bills in an unfolded configuration when no longer under the influence of the vacuum belt 38. Referring to FIG. 3, a top view of the currency creasing apparatus is shown. From above, a first creasing wheel 58 is shown between the vacuum belt 38 at the end of the slider slots 32. The first creasing wheel 58 is preferably the width of a single bill of currency. On either circumferential edge of the first creasing wheel 58, the profile of the surface facing the currency is slightly reduced to produce a channel 60. The currency is pressed into these channels 60, thus creasing the currency with a lengthwise ridge that prevents the currency from re-folding once it passes through the currency creasing apparatus 56. (rubber of a 60 durometer reading) $1/10^{th}$ of one inch.

Referring to FIG. 4, the currency creasing apparatus 56 is shown in side view. The first creasing wheel 58 is shown in position above a second creasing wheel 62. The second creasing wheel 62 has a circumferential profile complimentary to the first creasing wheel 58, including a bead 64 that fits within the channel 60 of the first creasing wheel 58. Thus, when a bill of currency travels through the currency creasing apparatus 56 from the slider slots 32 and vacuum belt 38 to the bill stacker 22, the channel 60 of the first creasing wheel 58 and the bead 64 of the second creasing wheel 62 crease the bills lengthwise. In the illustrated embodiment, two creased areas are created on currency bills as they travel through the currency creasing apparatus 56. In other embodiments one, or three or more creases may be created. In one preferred embodiment, the first creasing wheel 58 comprises a rubber or rubber-like material, and the second creasing wheel 62 comprises a metal material, such as iron or steel.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A currency arranging and stacking apparatus having a motorized hopper for receiving a plurality of paper currency bills, and a bill stacker for receiving and stacking unfolded and paper currency bills in a common orientation, the apparatus comprising:

a feed hopper configured for receiving a plurality of paper currency bills in bulk;

a pocket conveyor configured to elevate the plurality of paper currency bills and deposit the plurality of paper currency bills into the motorized hopper;

the motorized hopper comprising at least one feed regulator configured for separating overlapping individual paper currency bills;

a slider for receiving the separated individual paper currency bills, the slider having a series of slider slots, the slider slots configured to orient individual paper currency bills lengthwise and parallel to the slider slots;

a transport for receiving the individual paper currency bills oriented by the slider, the transport having a currency unfolding apparatus, the currency unfolding apparatus comprising a vacuum belt under negative pressure for holding the individual paper currency bills against the vacuum belt;

the currency unfolding apparatus further comprising a lower wheel engaging the vacuum belt, the lower wheel rotating at a speed different from the vacuum belt, thereby unfolding folded paper currency bills traveling between the lower wheel and the vacuum belt; and a currency creasing apparatus comprising a first creasing wheel and a second creasing wheel, the first creasing wheel and the second creasing wheel creasing the paper currency bills lengthwise to prevent the paper currency bills from re-folding before transmission to the bill stacker.

2. The apparatus of claim 1 wherein the pocket conveyor comprises a series of pockets for capturing a predetermined quantity of paper currency bills from the feed hopper.

3. The apparatus of claim 1 wherein the motorized hopper includes at least one motorized feed regulator for separating overlapping paper currency bills prior to depositing the separated paper currency bills on the slider.

4. The apparatus of claim 1 wherein the slider comprises a plurality of channels for receiving the separated paper currency bills from the motorized hopper.

5. The apparatus of claim 1 wherein the currency unfolding apparatus further comprises a servo motor configured to drive an upper wheel, the upper wheel configured to drive the lower wheel.

6. The apparatus of claim 1 wherein the first creasing wheel comprises at least one channel.

7. The apparatus of claim 6 wherein the first creasing wheel comprises a channel on either circumferential edge of the first creasing wheel.

8. The apparatus of claim 6 wherein the second creasing wheel comprises at least one complimentary channel configured to fit into the at least one channel of the first creasing wheel.

9. The apparatus of claim 8 wherein the first creasing wheel comprises rubber, and the second creasing wheel comprises steel.

10. A currency arranging and stacking apparatus having a motorized hopper for receiving a plurality of paper currency bills, and a bill stacker for receiving and stacking unfolded and paper currency bills in a common orientation, the apparatus comprising:

a feed hopper configured for receiving a plurality of paper currency bills in bulk;

a pocket conveyor configured to elevate the plurality of paper currency bills and deposit the plurality of paper currency bills into the motorized hopper;

the motorized hopper comprising at least one feed regulator configured for separating overlapping individual paper currency bills;

a slider for receiving the separated individual paper currency bills, the slider having a series of slider slots configured to orient individual paper currency bills lengthwise and parallel to the slider slots;

a currency unfolding apparatus comprising a moving vacuum belt and a lower wheel engaging the vacuum belt, the lower wheel configured to turn in the same direction as, but at a speed different from the vacuum belt, the vacuum belt being under negative pressure for holding the paper currency bills against the vacuum belt; and a currency creasing apparatus comprising a first creasing wheel and a second creasing wheel, the first creasing wheel and the second creasing wheel creasing the paper currency bills lengthwise to prevent the paper currency bills from re-folding before transmission to the bill stacker.

11. The apparatus of claim 10 wherein the currency unfolding apparatus further comprises a servo motor configured to drive an upper wheel, the upper wheel configured to drive the lower wheel.

12. The apparatus of claim 10 wherein the first creasing wheel comprises at least one channel.

13. The apparatus of claim 12 wherein the first creasing wheel comprises a channel on either circumferential edge of the first creasing wheel.

14. The apparatus of claim 12 wherein the second creasing wheel comprises at least one complimentary channel configured to fit into the at least one channel of the first creasing wheel.

15. The apparatus of claim 14 wherein the first creasing wheel comprises rubber, and the second creasing wheel comprises steel.

16. A currency arranging and stacking apparatus having a motorized hopper for receiving a plurality of paper currency bills, and a bill stacker for receiving and stacking unfolded and paper currency bills in a common orientation, the apparatus comprising:

a currency unfolding apparatus downstream from the motorized hopper, the currency unfolding apparatus comprising a moving vacuum belt and a lower wheel engaging the vacuum belt, the lower wheel configured to turn in a complimentary direction to the vacuum belt, and further configured to turn at a speed different from the vacuum belt, the vacuum belt being under negative pressure for holding the paper currency bills against the vacuum belt; and a currency creasing apparatus downstream from the currency unfolding apparatus, the currency creasing apparatus comprising a first creasing wheel and a second creasing wheel, the first creasing wheel and the second creasing wheel creasing the paper currency bills lengthwise to prevent the paper currency bills from re-folding before transmission to the bill stacker.

17. The apparatus of claim 16 wherein the currency unfolding apparatus further comprises a servo motor configured to drive an upper wheel, the upper wheel configured to drive the lower wheel.

18. The apparatus of claim 16 wherein the first creasing wheel comprises a channel on either circumferential edge of the first creasing wheel.

19. The apparatus of claim 18 wherein the second creasing wheel comprises at least one complimentary channel configured to fit into the channel of the first creasing wheel.

20. The apparatus of claim 19 wherein the first creasing wheel comprises rubber, and the second creasing wheel comprises steel.

* * * * *